US007573325B2

(12) United States Patent
Garcia

(10) Patent No.: US 7,573,325 B2
(45) Date of Patent: Aug. 11, 2009

(54) CMOS REFERENCE CURRENT SOURCE

(75) Inventor: Santiago Iriarte Garcia, Valencia (ES)

(73) Assignee: Texas Instruments Deutschland GmbH, Freising (DE)

( * ) Notice: Subject to any disclaimer, the term of this patent is extended or adjusted under 35 U.S.C. 154(b) by 0 days.

(21) Appl. No.: 11/536,799

(22) Filed: Sep. 29, 2006

(65) Prior Publication Data

US 2007/0075766 A1 Apr. 5, 2007

(30) Foreign Application Priority Data

Sep. 30, 2005 (DE) ..... 10 2005 047 032
Sep. 15, 2006 (DE) ..... 10 2006 043 452

(51) Int. Cl.
*G05F 1/10* (2006.01)
*G05F 3/02* (2006.01)

(52) U.S. Cl. ..... 327/543; 327/538; 323/313

(58) Field of Classification Search ..... 327/543, 327/538–541; 323/313, 315, 312, 317; 330/288
See application file for complete search history.

(56) References Cited

U.S. PATENT DOCUMENTS 4,507,573 A * 3/1985 Nagano ..... 327/542
2002/0039044 A1* 4/2002 Kwak et al. ..... 327/540
2004/0150465 A1* 8/2004 Nishida et al. ..... 327/541
2006/0001412 A1* 1/2006 Fernald ..... 323/313
2006/0132223 A1* 6/2006 Cherek ..... 327/538

FOREIGN PATENT DOCUMENTS

DE 19530472 8/1995
DE 19940382 8/1999

OTHER PUBLICATIONS

J. Webster (ed.), Wiley Encyclopedia of Electrical and Electronics Engineering. 1999 John Wiley & Sons, Inc. pp. 454-462.*

* cited by examiner

*Primary Examiner*—Tuan Lam
*Assistant Examiner*—Diana J Cheng
(74) *Attorney, Agent, or Firm*—John J. Patti; Wade J. Brady, III; Frederick J. Telecky, Jr.

(57) ABSTRACT

A CMOS reference current source comprises two circuit branches connected in parallel between supply terminals. The first circuit branch includes a series connection of a bias current source (MP1) and a first MOS transistor (MN1) of a first conductivity type. The second circuit branch includes a series connection of a diode-connected MOS transistor (MP2) of a second conductivity type, a second MOS transistor (MN2) of the first conductivity type and a third MOS transistor (MN3) of the first conductivity type. The first MOS transistor (MN 1) of the first conductivity type has its gate connected to the drain of the third MOS transistor (MN3) of the first conductivity type. The second MOS transistor (MN2) of the first conductivity type has its gate connected to the drain of the first MOS transistor (MN1) of the first conductivity type. The third MOS transistor (MN3) the first conductivity type has its gate connected to a bias source (MN4).

9 Claims, 1 Drawing Sheet

CMOS REFERENCE CURRENT SOURCE

The invention relates to a CMOS reference current source.

BACKGROUND

Current reference sources are basic building blocks in analog circuit design. In some very low power applications, a reference current source is needed that will supply not more than, e.g., 20 nA. With a conventional approach, resistors of a very high value (in the order of several MΩ) are required for this purpose. Resistors of high value need a large area on the chip. While current sources can also be designed without resistors, they all show a positive temperature coefficient and are not suitable for applications that require a negative temperature coefficient, such as needed, e.g., for some type of oscillators.

SUMMARY

In one embodiment, a CMOS reference current source in accordance with the principles of the invention comprises two circuit branches connected in parallel between supply terminals. The first circuit branch includes a series connection of a bias current source and a first MOS transistor of a first conductivity type. The second circuit branch includes a series connection of a diode-connected MOS transistor of a second conductivity type, a second MOS transistor of the first conductivity type and a third MOS transistor of the first conductivity type. The first MOS transistor of the first conductivity type has its gate connected to the drain of the third MOS transistor of the first conductivity type. The second MOS transistor of the first conductivity type has its gate connected to the drain of the first MOS transistor of the first conductivity type. The third MOS transistor of the first conductivity type has its gate connected to a bias source.

The described example CMOS reference current source uses only MOS transistors and can be implemented in a standard CMOS process. It has a very small power consumption and requires only a small chip area. No resistors or bipolar devices are needed. The inventive CMOS reference current source is of particular advantage as a bias current source for some very low power RC oscillators.

In the described reference current source, the generated current is approximately proportional to the transistor threshold voltage which, in turn, is inversely proportional to temperature. Accordingly, the generated current has the desired negative temperature coefficient.

In an embodiment where all bias currents are produced with a MOS transistor, the generated current is even inversely proportional to the square of temperature. In alternative embodiments where a negative temperature coefficient is not desired, bias currents are produced with a conventional design that has a positive temperature coefficient which counteracts the negative temperature coefficient of the transistor threshold voltage, thereby providing a reasonably temperature compensated reference current source.

BRIEF DESCRIPTION OF THE DRAWINGS

Further advantages and features of the invention will appear from the following detailed description with reference to the appending drawings, wherein.

DETAILED DESCRIPTION OF EXAMPLE EMBODIMENTS

Figure 1:
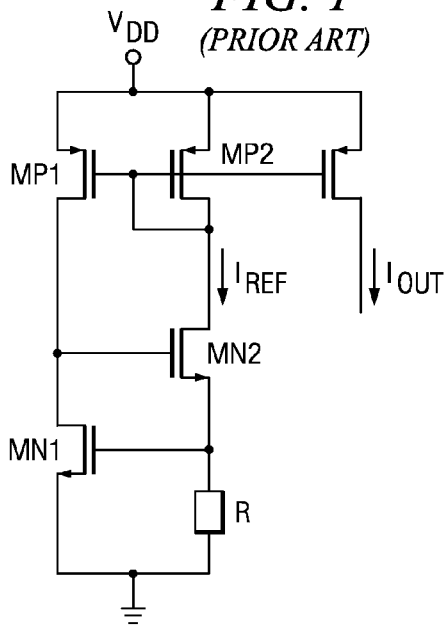
FIG. 1 (PRIOR ART)
FIG. 1 (Prior Art) is a schematic circuit diagram of a conventional reference current source with negative temperature coefficient.

FIG. 1 shows a conventional reference current source which requires a resistor R of a very high value for a very low power application. Specifically, the circuit in FIG. 1 has two circuit branches connected in parallel between supply terminal $V_{DD}$ and ground. The first branch is a series connection of a p-channel MOS transistor MP1 and an n-channel MOS transistor MN1. The second branch is a series connection of a diode-connected p-channel transistor MP2, an n-channel MOS transistor MN2 and a resistor R. Transistors MP1 and MP2 have their gates interconnected. Transistor MN1 has its gate connected to the source node of transistor MN2, the gate of which is connected to the drain node of transistor MN1. As a result, a reference current $I_{REF}$ is generated which flows through resistor R. An output current $I_{OUT}$ is provided using a further p-channel MOS transistor connected to mirror the reference current $I_{REF}$. As is readily understood, the gate-source voltage $V_{GS}$ of transistor MN1 is applied across resistor R, and the amount of output current $I_{OUT}$ is approximately proportional to the threshold voltage $V_{TH}$ of transistor MN1 divided by the resistance value of resistor R: $I_{OUT} \cong V_{GS}/R \cong V_{TH}/R$. As $V_{TH}$ is inversely proportional to temperature, $I_{OUT}$ has a negative temperature coefficient. For the ultra-low power applications of interest here, the resistance value of resistor R is typically in a range of 5 to 50 MΩ, requiring a lot of die space.

Figure 2:
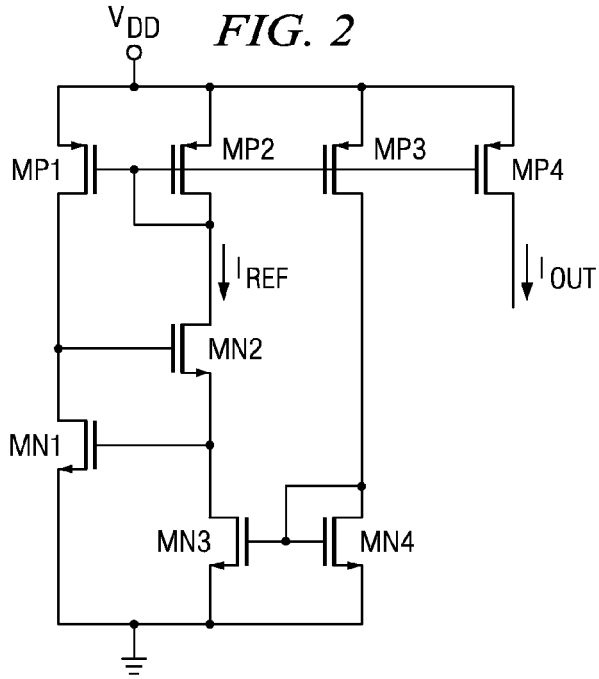
FIG. 2 is a schematic circuit diagram of an embodiment of a reference current source in accordance with principles of the invention.

FIG. 2 shows a first example embodiment of a reference current source in accordance with the principles of the invention. The circuit of FIG. 2 has the same basic structure as the circuit in FIG. 1, but the second circuit branch has an n-channel-transistor MN3 in place of the resistor R of the circuit in FIG. 1. In addition, a third circuit branch is connected between the supply terminals $V_{DD}$ and ground to provide a bias for the gate of transistor MN3. This third circuit branch has a p-channel transistor MP3 connected to mirror the reference current $I_{REF}$, connected in series with a diode-connected n-channel transistor MN4. The drain node of transistor MN4 provides the bias to the gate of transistor MN3. As in the arrangement of FIG. 1, the output current is provided with a further current mirror, formed by p-channel transistor MP4. Since, in this embodiment, the bias for transistor MN3 is provided by a MOS transistor within the same circuit (i.e., transistor MN4), the output current $I_{OUT}$ is proportional to the square of the transistor threshold value: $I_{OUT} \propto \mu \cdot V_{TH}^2$, wherein μ is the electron mobility. As the transistor threshold value $V_{TH}$ is inversely proportional to temperature and the electron mobility μ also has a negative temperature coefficient, the output current $I_{OUT}$ has a strong negative temperature coefficient, as desired for specific applications.

Figure 3:
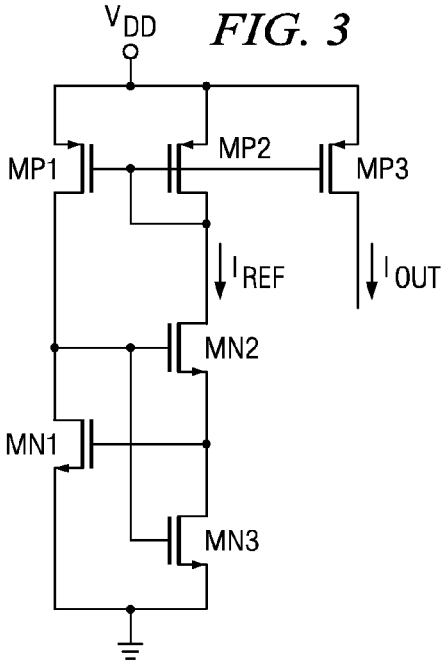
FIG. 3 is a schematic circuit diagram of another embodiment.

In the embodiment of FIG. 3, the bias for transistor MN3 is simply provided by the drain node of transistor MN1, thereby eliminating the third circuit branch with transistors MP3 and MN4 in the FIG. 2 embodiment. The remaining configuration and the operation of the FIG. 3 embodiment are generally the same as for the FIG. 2 embodiment.

Figure 4:
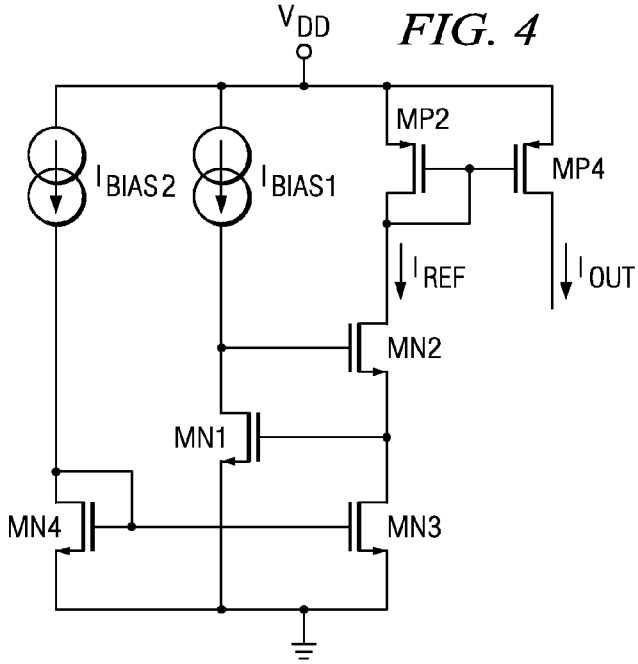
FIG. 4 is a schematic circuit diagram of a further embodiment.

In the embodiment of FIG. 4, a bias current source $I_{BIAS1}$ is provided in place of transistor MP1 of the FIG. 2 embodiment. In a similar manner, a bias current source $I_{BIAS2}$ is provided in place of transistor MP3 of the FIG. 2 embodiment. If a conventional design without resistors and with a positive temperature coefficient is selected for bias current sources $I_{BIAS1}$ and $I_{BIAS2}$, the resulting output current will be substantially temperature compensated: $I_{OUT} \propto \mu \cdot V_T \cdot V_{TH}$, where $V_T = k \cdot T/q$, with k=Boltzmann factor, T=temperature; and q=electron charge.

Those skilled in the art to which the invention relates will appreciate that various changes may be made to the described example embodiments and additional embodiments developed within the scope of the claimed invention.

What is claimed is:

1. A CMOS reference current source comprising:

a first circuit branch connected between supply terminals and including a series connection of a bias current source and a first MOS transistor of a first conductivity type; and a second circuit branch connected between the supply terminals in parallel with the first circuit branch, and including a series connection of a diode-connected MOS transistor of a second conductivity type, a second MOS transistor of the first conductivity type and a third MOS transistor of the first conductivity type; and wherein the first MOS transistor of the first conductivity type has its gate connected to the drain of the third MOS transistor of the first conductivity type, the second MOS transistor of the first conductivity type has its gate connected to the drain of the first MOS transistor of the first conductivity type, and the third MOS transistor of the first conductivity type has its gate connected to a bias source; and wherein the bias source for the third MOS transistor of the first conductivity type is provided by the drain node of the first MOS transistor of the first conductivity type.

2. The reference current source of claim 1, wherein the bias current source in the first circuit branch has a positive temperature coefficient.

3. The reference current source of claim 1, wherein the bias source for the third MOS transistor of the first conductivity type is provided by a current source that has a positive temperature coefficient.

4. The reference current source of claim 1, wherein the output current circuit branch comprises another MOS transistor of the second conductivity type connected to mirror the current flowing in the second circuit branch.

5. The reference current source of claim 4, wherein the current in the second circuit branch has a negative temperature coefficient.

6. The reference current source of claim 1, wherein the current in the second circuit branch has a negative temperature coefficient.

7. A CMOS reference current source comprising:

a first circuit branch connected between supply terminals and including a series connection of a bias current source and a first NMOS transistor;

a second circuit branch connected between the supply terminals in parallel with the first circuit branch, and including a series connection of a diode-connected PMOS transistor, a second NMOS transistor and a third NMOS transistor; and an output current circuit branch connected to provide an output current comprising another PMOS transistor connected to mirror the current flowing in the second circuit branch;

wherein the first NMOS transistor has its gate connected to the drain of the third NMOS transistor, the second NMOS transistor has its gate connected to the drain of the first NMOS transistor, and the third NMOS transistor has its gate connected to a bias source;

wherein the bias source for the third NMOS transistor is provided by the drain node of the first NMOS transistor.

8. The reference current source of claim 7, wherein the bias current source in the first circuit branch has a positive temperature coefficient.

9. The reference current source of claim 7, wherein the current in the second circuit branch has a negative temperature coefficient.

* * * * *